US005880665A

United States Patent [19]

Yetter et al.

[11] Patent Number: 5,880,665

[45] Date of Patent: Mar. 9, 1999

[54] FUSE HOLDER

[75] Inventors: Gary Neil Yetter, Elizabethtown; Michael Scott Feher, Steelton, both of Pa.

[73] Assignee: The Whitaker Corporation, Wilmington, Del.

[21] Appl. No.: 83,616

[22] Filed: May 22, 1998

[51] Int. Cl.[6] ..... H01H 85/20; H01H 85/22; H01H 85/56; H01H 85/60

[52] U.S. Cl. ..... 337/227; 337/228; 337/256; 337/257; 337/187; 337/188; 361/833; 361/835; 361/626; 361/642

[58] Field of Search ..... 337/227, 228, 337/256, 257, 187, 188, 201, 213; 361/626, 642, 646, 833, 835

[56] References Cited

U.S. PATENT DOCUMENTS

| | | | |
|---|---|---|---|
| 3,860,319 | 1/1975 | Slater | 339/99 R |
| 4,238,140 | 12/1980 | Cairns et al. | 339/186 M |
| 4,332,002 | 5/1982 | Yamaguchi et al. | 361/432 |
| 5,073,131 | 12/1991 | Levine | 439/621 |
| 5,085,600 | 2/1992 | Damron | 439/621 |
| 5,631,619 | 5/1997 | Evans | 337/198 |
| 5,670,928 | 9/1997 | Cheng et al. | 337/188 |
| 5,680,088 | 10/1997 | Seki et al. | 337/194 |

*Primary Examiner*—Leo P. Picard
*Assistant Examiner*—Anatoly Vortman
*Attorney, Agent, or Firm*—Anton P. Ness

[57] ABSTRACT

A holder (10) for a fuse (18) of the type typically used in automobile and marine applications. The fuse includes a fuse element encased within a generally rectilinear insulative fuse body (20), with a pair of parallel coplanar conductive blades (22, 24) in contact with opposite ends of the fuse element and extending out the fuse body. The holder is a unitary molded insulative plastic piece having a base member (12), a capture plate (14), and a cover member (16). The capture plate and cover member are hingedly secured to the base member on opposite sides thereof, with the capture plate adapted to overlie the base member and the cover member adapted to overlie the capture plate. The base member includes pockets with retention wings (50) for holding wire- terminating receptacles (28) and the capture plate locks the receptacles in place by means of blocks (62) extending into the pockets. The capture plate includes apertures (58, 60) aligned with the receptacles for receiving therethrough the fuse blades. The cover member includes a cavity (92) for holding the fuse bodies of the fuses engaged with the receptacles and strain relief blocks (96) engaging the wire segments (52) terminated by the receptacles.

11 Claims, 5 Drawing Sheets

FUSE HOLDER

FIELD OF THE INVENTION

This invention relates to fuse holders and, more particularly, to a holder for fuses of the type typically used in unsealed automobile and unsealed marine applications.

BACKGROUND OF THE INVENTION

A fuse of the aforementioned type typically includes a fuse element encased within a generally rectilinear insulative body. A pair of parallel coplanar conductive blades in contact with opposite ends of the fuse element extend out of the fuse body along a narrow edge thereof and are substantially parallel to a major surface of the fuse body. It is desired to provide a holder for inserting such a fuse in series circuit with a pair of wires terminated by receptacles engageable with the conductive connecting blades of the fuse. The holder should be economical to manufacture, should securely hold the wires and receptacles, and should provide easy access for insertion and removal of a fuse.

SUMMARY OF THE INVENTION

The present invention provides a holder for a fuse of the type having a fuse body and a pair of spaced conductive contacts extending from the fuse body. The holder facilitates the connection of the fuse in series circuit with a pair of wires each terminated by a respective contact receiving receptacle and comprises an insulative base and an insulative capture plate. The base includes structure adapted to position the pair of receptacles in spaced relationship corresponding to the spacing between the pair of fuse contacts. The capture plate is hingedly secured to the base, is positionable in overlying relation to the base, and is formed with at least one aperture for receiving at least one of the fuse contacts therethrough. The aperture is so positioned that when the capture plate overlies the base a pair of fuse contacts are insertable into respective receptacles positioned on the base with the fuse body on the other side of the capture plate from the base. The capture plate includes structure on its side facing the base which is adapted to prevent removal of the pair of receptacles from the base when the capture plate overlies the base.

In accordance with an aspect of this invention, the fuse holder further comprises an insulative cover having a cavity for receiving the fuse body and being hingedly secured to the base so as to be positionable in overlying relation to the capture plate when the capture plate overlies the base.

In accordance with another aspect of this invention, the cover includes structure for providing strain relief for the wires associated with the receptacles.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 4:
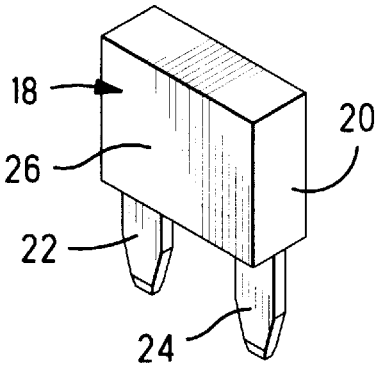
FIG. 4 is an isometric view of a fuse of the type adapted to be used with the fuse holder shown in FIG. 1.

Referring now to the drawings, an exemplary fuse holder, designated generally by the reference numeral 10 and constructed according to the present invention, is preferably a unitary molded insulative plastic piece comprising three major components—a base member 12, a capture plate 14, and a cover member 16. The purpose of the fuse holder 10 is to facilitate the insertion/removal of a fuse 18 of the type shown in FIG. 4 in series circuit with a pair of wires. The fuse 18 is of the type typically used in automobile and marine applications and includes a fuse element (not shown) encased within a generally rectilinear insulative fuse body 20. A pair of parallel coplanar conductive blades 22, 24 are in contact with opposite ends of the internal fuse element and extend out of the fuse body 20 along a narrow edge thereof and are substantially parallel to a major surface 26 of the fuse body 20. The fuse 18 is generally commercially available in auto and marine parts stores and forms no part of the present invention.

Figure 5:
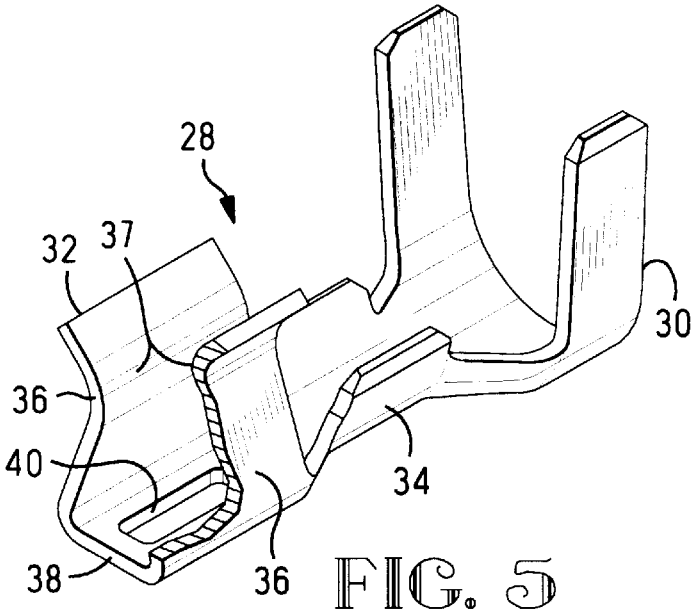
FIG. 5 is an isometric view, partially cut away, showing an exemplary wire terminating contact-receiving receptacle.

The wires to which the fuse 18 are to be connected are typically insulated. Each of the wires is terminated by a receptacle 28, an illustrative embodiment of which is shown in FIG. 5. The receptacle 28 is designed for the insertion/removal of a fuse blade in a direction transverse to the wire which is terminated by the receptacle 28. The receptacle 28 is preferably stamped and formed from sheet stock material, illustratively brass, and includes an insulation crimping barrel 30 at a first end, a blade engaging portion 32 at a second end, and a wire crimping barrel 34 between the insulation crimping barrel 30 and the blade engaging portion 32. The blade engaging portion 32 includes a pair of spring arms 36 extending upwardly from a generally flat connecting portion 38. As the spring arms 36 extend upwardly from the connecting portion 38, they are directed inwardly toward each other to a contact region 37 and then away from each other to their distal ends. When unstressed, at their contact regions 37, the spring arms 36 are spaced apart by a distance less than the thickness of a fuse blade 22, 24. Accordingly, a fuse blade 22, 24 received between the spring arms 36 provides a camming action to the outwardly extending distal ends of the spring arms 36 to separate the spring arms 36. The resiliency of the spring arms 36 results in frictional engagement between the contact regions 37 of the spring arms 36 and the inserted fuse blade 22, 24 to provide good conductive contact therebetween. The connecting portion 38 of the blade engaging portion 32 is formed with an open slot 40 aligned with an inserted fuse blade 22, 24 and sized to allow the fuse blade 22, 24 to pass therethrough, for a purpose to be described hereinafter.

The exemplary fuse holder 10 is shown as being a four-position fuse holder. It is understood, however, that it may be constructed to hold any other desired number of fuses. As shown, the base member 12 is formed with a generally rectangular planar base plate 42 having a pair of opposed co-planar mounting tabs 44. The base member 12 includes a pair of pockets for each of the fuses to be held by the holder 10. Each of the pockets is adapted to hold a respective wire-terminating receptacle 28. The pockets are generally rectangular and are formed by walls extending to a uniform height orthogonally from the base plate 42. Thus, to form the eight pockets required for the four fuses, there are five longitudinally extending lateral walls 46 and an orthogonal central wall 48. Accordingly, each pocket is bounded by the base plate 42, the central wall 48, and a pair of lateral walls 46, and is open opposite the base plate 42 and opposite the central wall 48. Extending into each of the pockets from its bounding lateral walls 46, is a pair of retention wings 50, whose purpose will be described hereinafter. Each of the retention wings 50 is a relatively thin blade-like element which extends inwardly of the pocket at an acute angle from the respective lateral wall 46 and toward the central wall 48. The retention wings 50 of each pocket are spaced equally from the central wall 48.

Figure 6:
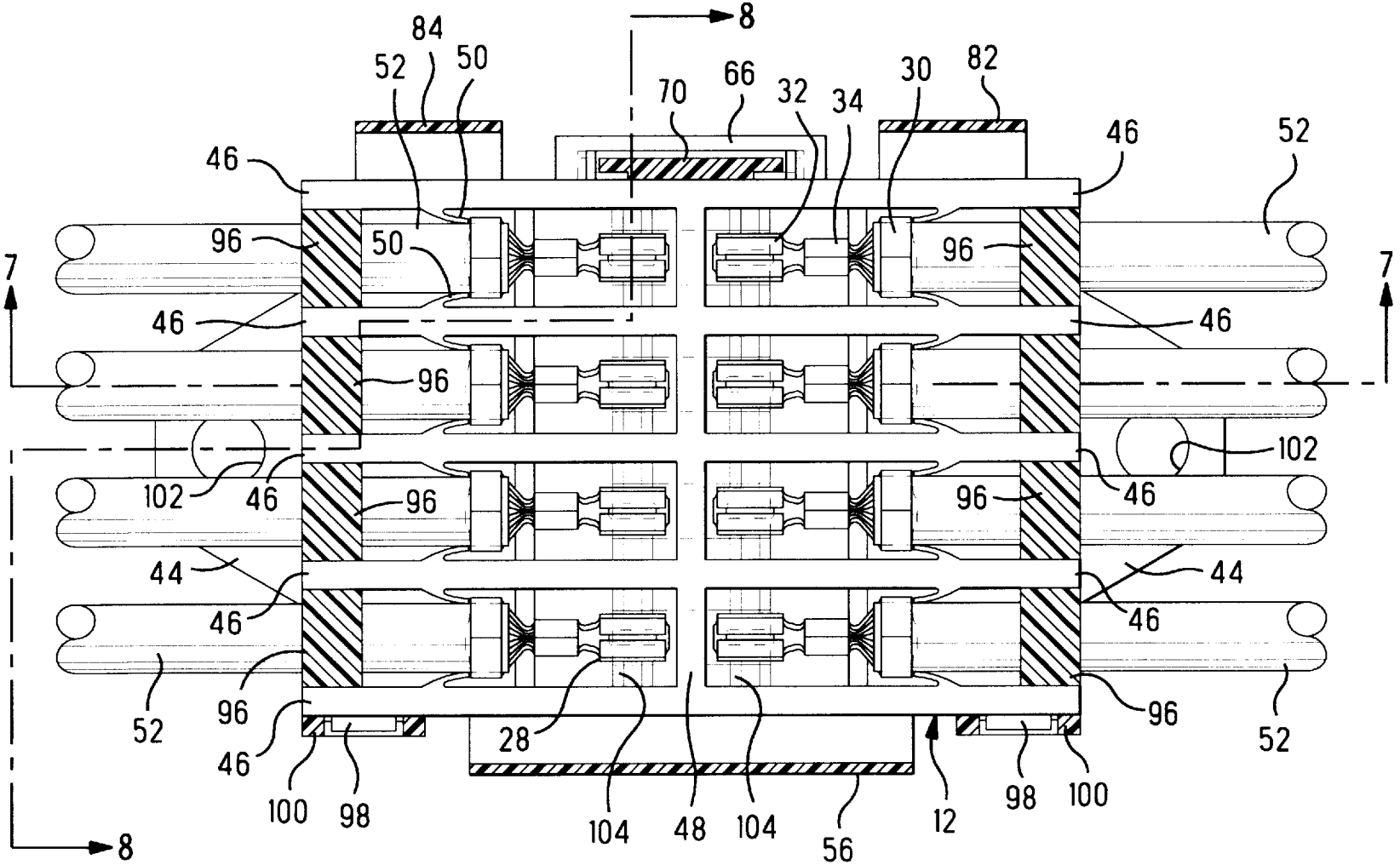
FIG. 6 is a cross sectional view, taken along the line 6—6 in FIG. 8, of a completely assembled fuse holder of the type shown in FIG. 1.

As shown in FIG. 6, each pocket of a pair of pockets separated by the central wall 48 is adapted to hold a respective one of a pair of receptacles 28 and the adjacent wire segment 52 of the wire terminated by that receptacle 28. The spacing of the retention wings 50 from the central wall 48 provides enough space for the receptacle 28 to be received in the pocket between the central wall 48 and the retention wings 50. However, the wings 50 extend sufficiently into the pocket so that they are more closely spaced at their distal ends than the outer diameter of the adjacent wire segment 52. Accordingly, when a receptacle 28 is inserted into a pocket, the curvature of the wire segment 52 provides a camming action which causes the wings 50 to be flexed outwardly toward their respective lateral walls 46. The outer diameter of the insulation crimping barrel 30 at the first end of the receptacle 28 is greater than the outer diameter of the adjacent wire segment 52. Accordingly, the wings 50 interferingly engage with the first end of the receptacle 28 to inhibit longitudinal removal of the receptacle 28 from its pocket and temporarily hold the receptacle 28 in place in its pocket during assembly of the holder 10. The spacing between receptacles 28 occupying a pair of pockets separated by the central wall 48 is such that the pair of blade engaging portions 32 are spaced apart a distance corresponding to the distance between the fuse blades 22, 24. Further, the receptacles 28 are held in the pockets so that the pair of adjacent wire segments 52 corresponding to a particular fuse position are substantially co-linear.

Figure 7:
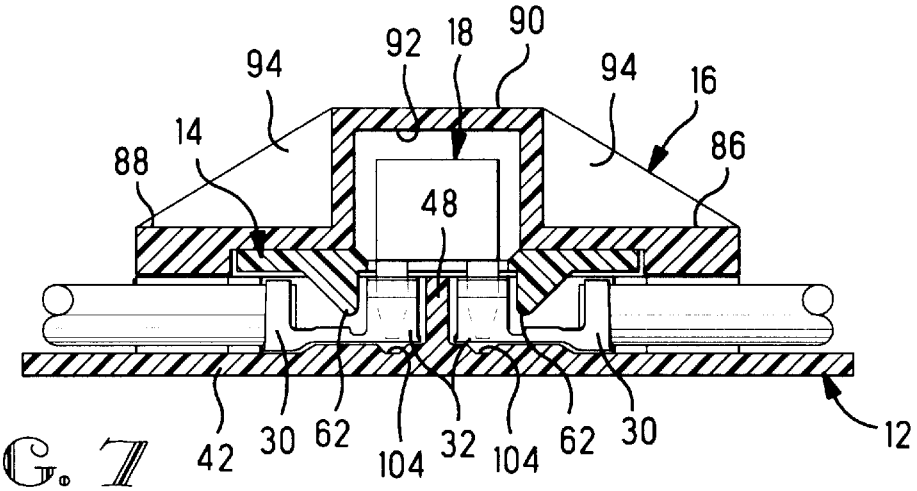
FIG. 7 is a cross sectional view taken along the line 7—7 in FIG. 6.

The capture plate 14 is a generally rectangular plate member connected along its edge 54 to an outer lateral wall 46 of the base member 12 by the living hinge 56 and is adapted to overlie the base member 12. The living hinge 56 allows the capture plate 14 to move relative to the base member 12 about a hinge axis which is substantially parallel to the adjacent wire segments 52. The capture plate 14 is formed with a pair of spaced apertures 58, 60 corresponding to each fuse position, and each for receiving therethrough a respective blade 22, 24 of a fuse 18. Each of the apertures 58, 60 is aligned with a respective blade engaging portion 32 of a receptacle 28 in a pocket of that fuse position. The capture plate 14 is further formed with a plurality of receptacle limiting blocks 62 associated with each of the pockets. As shown in FIG. 7, when the capture plate 14 overlies the base member 12, each receptacle limiting block 62 extends into its respective pocket outward of the blade engaging portion 32 of the receptacle 28 and has a portion which is longitudinally co-extensive with a portion of the blade engaging portion 32 to prevent longitudinally removal of the receptacle 28 from the pocket. Illustratively, each of the receptacle limiting blocks 62 is triangular in cross section taken parallel to the lateral walls 46. Thus, the blocks 62 permanently hold the receptacles 28 in their pockets after assembly of the fuse holder 10.

Figure 1:
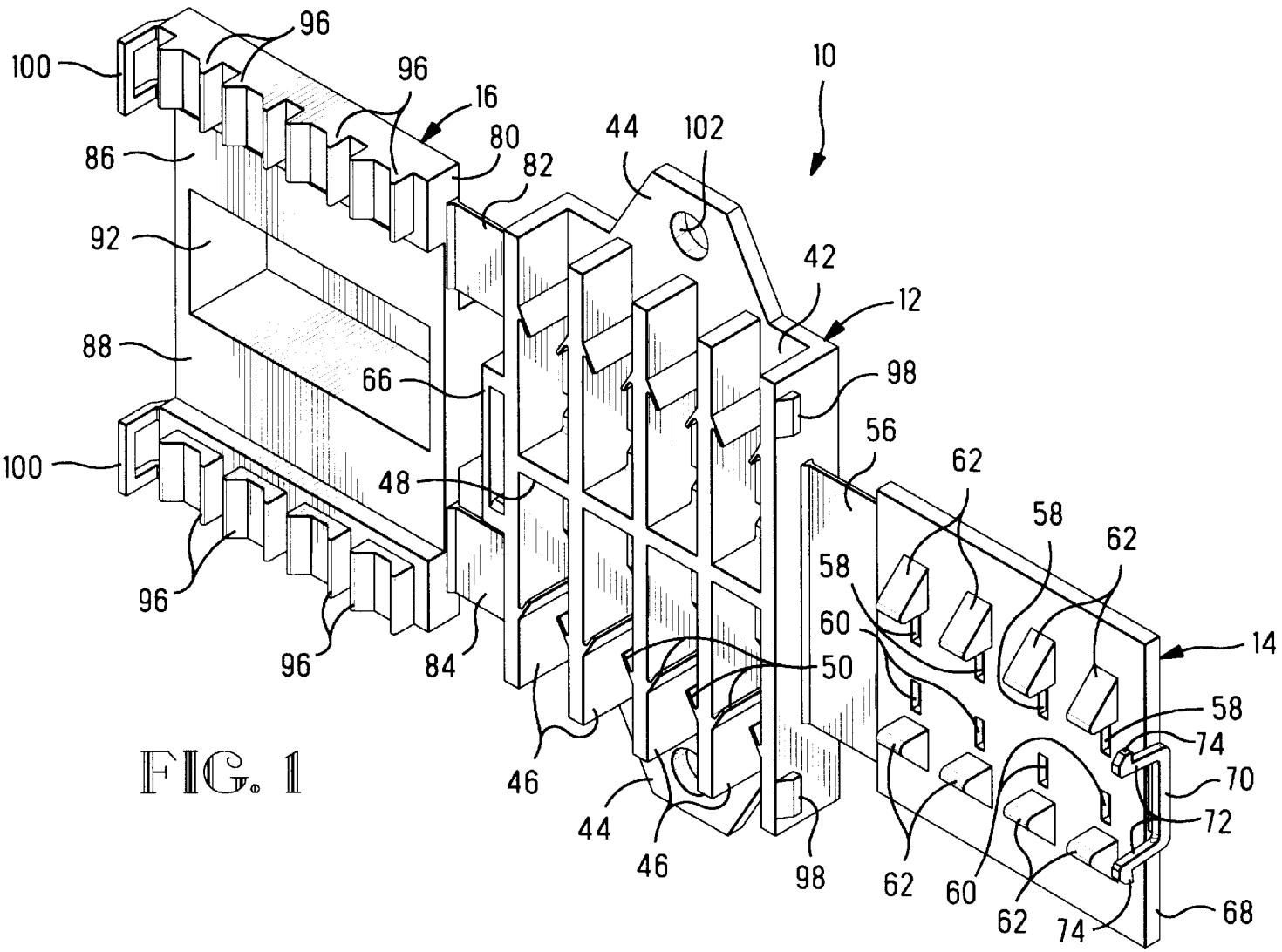
FIG. 1 is a front isometric view of an exemplary four-position fuse holder constructed in accordance with the present invention, shown in its fully open position prior to the introduction of wires or fuses therein.
Figure 2:
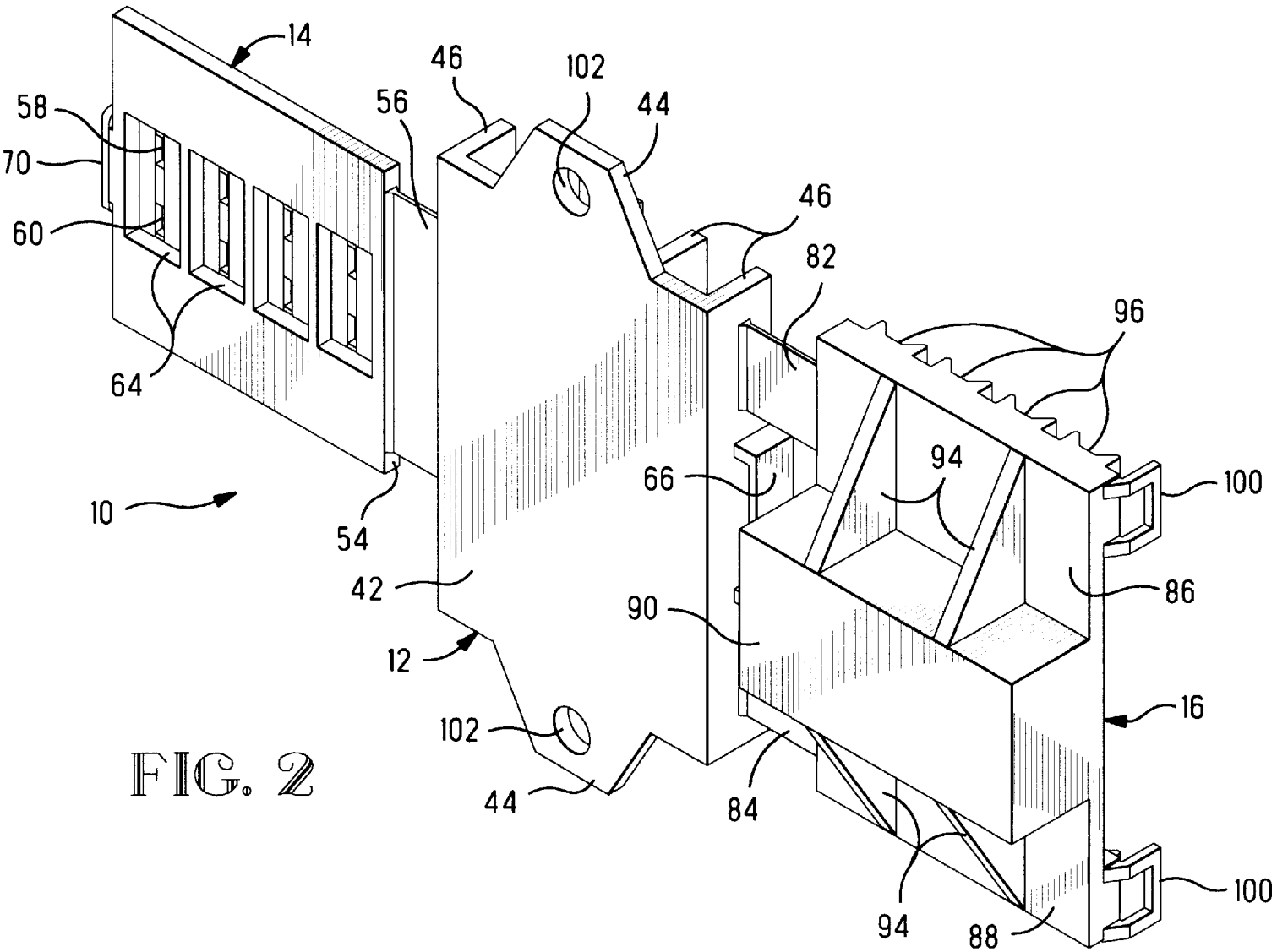
FIG. 2 is a rear isometric view of the fuse holder shown in FIG. 1.
Figure 3:
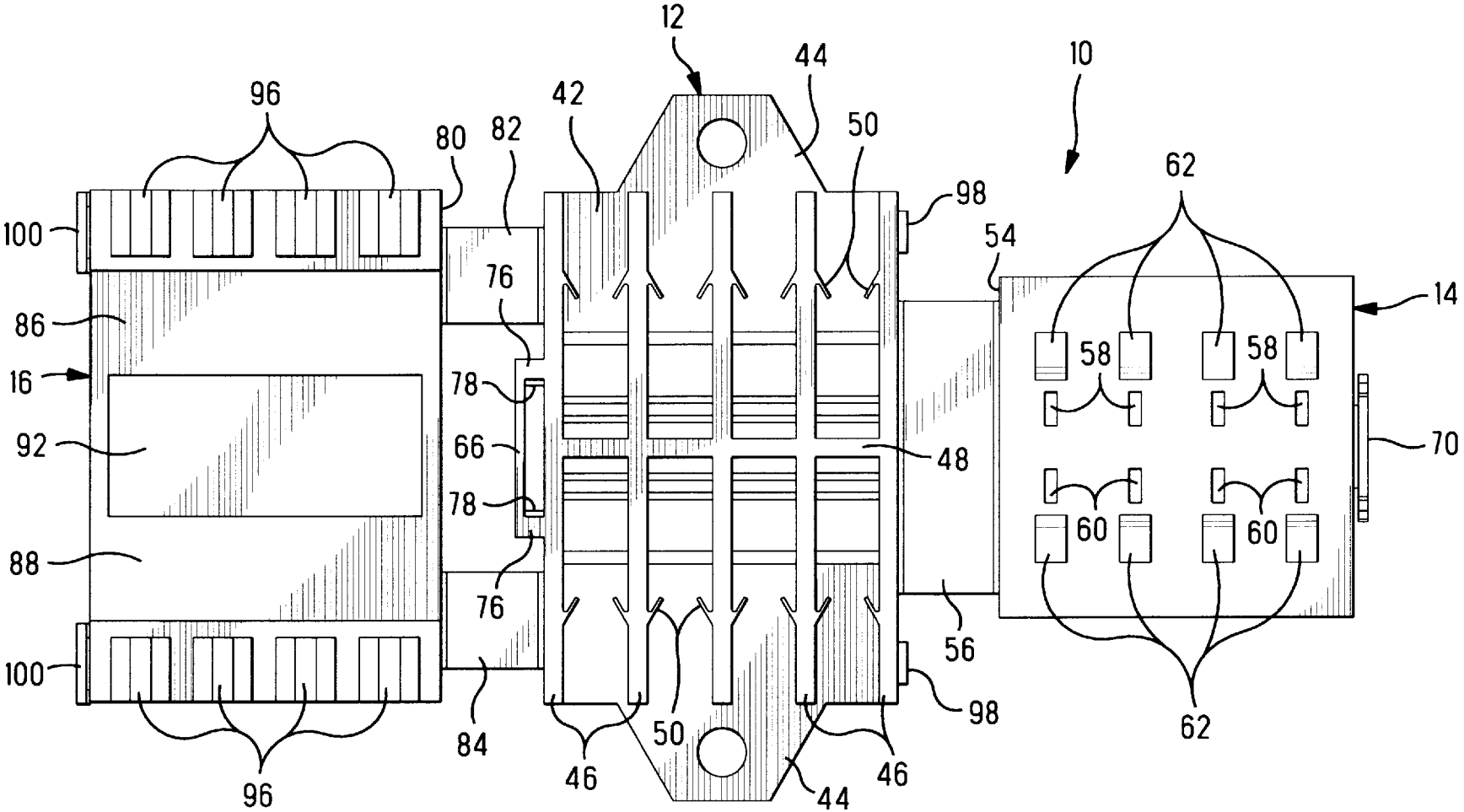
FIG. 3 is a top plan view of the fuse holder shown in FIG. 1.

As best shown in FIG. 2, on the side of the capture plate 14 opposite the limiting blocks 62, the capture plate 14 is formed with a respective recess 64 surrounding each pair of blade-receiving apertures 58, 60. Each recess 64 is preferably rectangular in plan view and defines a fuse position for inserting a fuse 18 into the holder 10.

To secure the capture plate 14 in overlying relation to the base member 12, the base member 12 and the capture plate 14 are formed with complementary snap-fit features on their sides opposite the hinge 56. Thus, on the exterior surface of the lateral wall 46 opposite the hinge 56, the base member 12 is formed with a holder 66 having three walls to define an interior space. Extending from the edge 68 opposite the hinge 56, the capture plate 14 has a lock member 70 with a pair of opposed lock arms 72 having outwardly extending interference members (barbs) 74 at their distal ends. The interference members 74 are formed at their leading ends with angled camming surfaces which cooperate with the opposed walls 76 of the holder 66 to flex the lock arms 72 toward each other and allow them to enter the interior space of the holder 66. The opposed walls 76 of the holder 66 are formed with inwardly extending ledges 78, and when the interference members 74 pass the ledges 78 they snap outwardly to lock the capture plate 14 in overlying relation to the base member 12.

The cover member 16 is adapted to overlie the capture plate 14 with the capture plate 14 overlying the base member 12. As shown, the cover member 16 is generally rectangular in plan view and is connected along its edge 80 to the outer lateral wall 46 of the cover member 12 having the holder 66 by a pair of spaced living hinges 82, 84 flanking the holder 66. The living hinges 82, 84 allow the cover member 16 to move relative to the base member 12 about a hinge axis which is substantially parallel to the adjacent wire segments 52. The cover member 16 includes a pair of substantially planar plate portions 86, 88 separated by a tower portion 90 having an internal cavity 92 for receiving the bodies 20 of the fuses 18 installed in the holder 10. The triangular ribs 94 connecting the sides of the tower portion 90 to the plate portions 86, 88 provide structural rigidity for the cover member 16.

Figure 8:
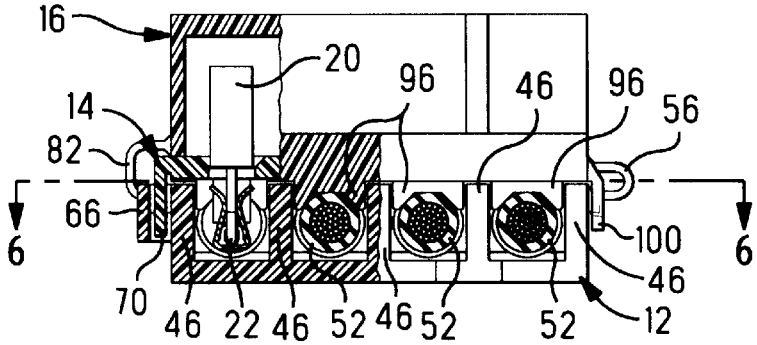
FIG. 8 is a cross sectional view taken along the line 8—8 in FIG. 6.

At their outer ends, the plate portions 86, 88 are thickened and on their sides opposite the tower portion 90 are formed with an array of strain relief blocks 96. When the cover member 16 overlies the capture plate 14, the thickened ends of the plate portions 86, 88 containing the two arrays of strain relief blocks 96 flank the capture plate 14. Each of the strain relief blocks 96 extends into a respective one of the pockets of the base member 12 and, as best shown in FIG. 8, bears against a respective one of the adjacent wire segments 52 to provide strain relief thereto.

To secure the cover member 16 in overlying relation to the capture plate 14 and the base member 12, the base member 12 and the cover member 16 are formed with complementary snap-fit features on their sides opposite the hinges 82, 84. Thus, on the exterior surface of the lateral wall 46 opposite the hinges 82, 84, the base member 12 is formed with a pair of ramped abutments 98 flanking the hinge 56. To cooperate with the abutments 98, the cover member 16 is formed with a corresponding pair of lock members 100. Each of the lock members 100 is illustratively a U-shaped piece that cams over the ramped surface of its respective abutment 98 and snaps toward the wall 46 to prevent subsequent inadvertent opening of the cover member 16.

As shown in FIGS. 6 and 7, below each blade engaging portion 32, the base member 12 has a recess 104, in the form of a transverse channel across each pocket. Each recess 104 is aligned with the slot 40 of the respective receptacle 28. Accordingly, if a fuse blade 22, 24 is longer than the depth of a receptacle 28 blade engaging portion 32, the blade can be accommodated by extending through the slot 40 and into the recess 104.

To use the fuse holder 10, the base member 12 is secured to an appropriate flat surface, illustratively by inserting screws through the openings 102 in the mounting tabs 44. Receptacles 28 terminating respective wire segments 52 are then installed in their respective pockets on the base member 12 and are temporarily held therein by the retention wings 50. The capture plate 14 is then placed in overlying relation to the base member 12 and held in place by the cooperating snap-fit holder 66 and lock member 70. The blocks 62 prevent removal of the receptacles 28 from their pockets. Fuses 18 are then installed by inserting their blades 22, 24 through respective apertures 58, 60 and into contact with the blade engaging portions 32 of respective receptacles 28. The cover member 16 is then placed in overlying relation to the capture plate 14, with the fuse bodies 20 received in the cavity 92, and is held in place in a snap-fit manner by the abutments 98 and lock members 100. The strain relief blocks 96 engage the wire segments 62 to provide strain relief thereto. If it is desired to change a fuse 18, the lock members 100 are released from the abutments 98 and the cover member 16 is pivoted away from the capture plate 14/base member 12. The capture plate 14 remains in place and a desired fuse 18 can be removed and/or replaced. The cover member 16 is then repositioned and locked in place.

Accordingly, there has been disclosed an improved fuse holder for fuses of the type typically used in automobile and marine applications. While an illustrative embodiment of the present invention has been disclosed herein, it is understood that various modifications and adaptations to the disclosed embodiment will be apparent to one of ordinary skill in the art and it is intended that this invention be limited only by the scope of the appended claims.

What is claimed is:

1. A holder for a fuse of the type having an insulative fuse body with an internal fuse element and a pair of conductive blades in contact with said fuse element and extending from said fuse body, said holder facilitating the connection of said fuse in series circuit with a pair of insulated wires and comprising:

a pair of conductive receptacles each terminating a respective one of said wires and each including an insulation crimping barrel at a first end, a blade engaging portion at a second end having a pair of spring arms spaced apart when unstressed by a distance less than the thickness of a fuse blade, and a wire crimping barrel between said insulation crimping barrel and said blade engaging portion;

an insulative base member having a pair of pockets each for receiving a respective one of said receptacles and an adjacent wire segment, with the pair of wires terminated by said pair of receptacles extending outwardly from said base member pockets in opposite directions and with the pair of adjacent wire segments being substantially co-linear, said base member further having associated with each of said pockets a pair of retention wings extending into said each pocket and flanking a respective adjacent wire segment outward of the respective receptacle first end, each pair of retention wings adapted for interfering engagement with the respective receptacle first end to inhibit longitudinal removal of the respective receptacle from the respective pocket; and an insulative capture plate adapted to overly said base member after said receptacles are received in said pockets, said capture plate including a pair of apertures each for receiving a respective blade of said fuse, each of said pair of apertures being aligned with a respective receptacle blade engaging portion.

2. The holder according to claim 1 wherein said capture plate includes a receptacle limiting block associated with each of said pockets, each said block extending into its respective pocket outward of the respective receptacle blade engaging portion and having a portion longitudinally co-extensive with a portion of said blade engaging portion to prevent longitudinal removal of the respective receptacle from the respective pocket.

3. The holder according to claim 1 wherein said capture plate is hingedly secured to said base member.

4. The holder according to claim 3 wherein said base member and said capture plate are formed with complementary snap-fit features on their sides opposite from the hinged securement of said capture plate to said base member and adapted to lock said capture plate in overlying relation to said base member.

5. The holder according to claim 1 wherein:

said receptacle blade engaging portion is formed with a connecting portion joining said spring arms at their ends opposite where said fuse blade enters therebetween, said connecting portion having an open slot aligned with said fuse blade and sized to allow said fuse blade to pass therethrough; and said base member is formed with a respective recess below each said receptacle and aligned with said open slot;

whereby the holder can accommodate fuses with a fuse blade length which extends beyond the depth of said receptacle blade engaging portion.

6. The holder according to claim 1 further comprising:

an insulative cover member adapted to overly said capture plate after said fuse blades are received in said capture plate apertures and engaged with said receptacles, said cover member including a cavity for receiving said fuse body.

7. The holder according to claim 6 wherein said cover member includes a pair of strain relief blocks each adapted to extend into a respective pocket and engage a respective adjacent wire segment.

8. The holder according to claim 6 wherein said cover member is hingedly secured to said base member.

9. The holder according to claim 8 wherein said base member and said cover member are formed with complementary snap-fit features on their sides opposite from the hinged securement of said cover member to said base member and adapted to lock said cover member in overlying relation to said capture plate.

10. The holder according to claim 6 wherein:

said base member, said capture plate and said cover member are formed as part of a unitary plastic molded piece with a first living hinge connecting said capture plate to said base member and a second living hinge connecting said cover member to said base member;

said first living hinge is on a first side of said base member and allows said capture plate to move relative to said base member about a first hinge axis substantially parallel to said adjacent wire segments;

said capture plate and said base member are formed with first complementary snap-fit features on their sides opposite said first living hinge to lock said capture plate in overlying relation to said base member;

said second living hinge comprises a pair of second living hinge members on the side of said base member opposite said first living hinge, said pair of second living hinge members flanking the first snap-fit feature on said base member and allowing said cover member to move relative to said base member about a second hinge axis substantially parallel to said first hinge axis; and said cover member and said base member are formed with second complementary snap-fit features on their sides opposite said second living hinge to lock said cover member in overlying relation to said capture plate, said second complementary snap-fit features comprising a pair of second snap-fit feature sets flanking said first living hinge on said base member.

11. The holder according to claim 1 adapted to hold a plurality of fuses of the type described wherein for each of said plurality of fuses there is provided:

a respective pair of conductive receptacles of the type described and each terminating a respective wire;

a respective pair of pockets of the type described on said base member, with the pairs of pockets arranged to position their respective receptacles so that the pairs of adjacent wire segments are in a parallel array; and a respective pair of apertures of the type described in said capture plate.

* * * * *